US010174709B2

(12) United States Patent
Hemink et al.

(10) Patent No.: US 10,174,709 B2
(45) Date of Patent: Jan. 8, 2019

(54) INTERNAL COMBUSTION ENGINE HAVING AT LEAST ONE CYLINDER HEAD COMPRISING AT LEAST TWO CYLINDERS

(71) Applicant: Ford Global Technologies, LLC, Dearborn, MI (US)

(72) Inventors: Wilbert Hemink, Landgraaf (NL); Bas van den Heuvel, Wijnandsrade (NL)

(73) Assignee: Ford Global Technologies, LLC, Dearborn, MI (US)

( * ) Notice: Subject to any disclaimer, the term of this patent is extended or adjusted under 35 U.S.C. 154(b) by 61 days.

(21) Appl. No.: 15/407,182

(22) Filed: Jan. 16, 2017

(65) Prior Publication Data

US 2017/0218880 A1 Aug. 3, 2017

(30) Foreign Application Priority Data

Jan. 28, 2016 (DE) ..... 10 2016 201 248

(51) Int. Cl.

| | |
|---|---|
| ***F01N 3/20*** | (2006.01) |
| ***F01N 13/10*** | (2010.01) |
| ***F02F 1/24*** | (2006.01) |
| ***F02F 1/42*** | (2006.01) |
| ***F01N 13/18*** | (2010.01) |

(52) U.S. Cl.

CPC ..... *F02F 1/243* (2013.01); *F01N 13/10* (2013.01); *F01N 13/105* (2013.01); *F01N 13/1805* (2013.01); *F02F 1/4264* (2013.01)

(58) Field of Classification Search

CPC ..... F01N 13/10; F01N 13/102; F01N 13/105; F01N 13/107; F01N 13/1805; F02F 1/243; F02F 1/4264; Y02T 10/144

USPC ..... 60/323

See application file for complete search history.

(56) References Cited

U.S. PATENT DOCUMENTS

| | | | | |
|---|---|---|---|---|
| 4,294,073 | A * | 10/1981 | Neff | F01N 13/10 415/205 |
| 4,689,952 | A * | 9/1987 | Arthur | F01N 13/10 29/428 |
| 5,860,278 | A * | 1/1999 | Rodenkirch | F01N 13/10 60/274 |
| 2010/0095671 | A1 | 4/2010 | Takagawa et al. | |

(Continued)

FOREIGN PATENT DOCUMENTS

| | | | |
|---|---|---|---|
| DE | 102014216814 | A1 | 3/2015 |
| GB | 2515604 | A | 12/2014 |
| WO | 2013172129 | A1 | 11/2013 |

*Primary Examiner* — Mark Laurenzi
*Assistant Examiner* — Dapinder Singh
(74) *Attorney, Agent, or Firm* — Julia Voutyras; McCoy Russell LLP

(57) ABSTRACT

Systems are provided for an integrated exhaust manifold that may be used in a variety of engine systems. In one example, an integrated exhaust manifold may include a central axis running from an inlet end to an outlet end of the integrated exhaust manifold and two exhaust outlets arranged at the outlet end and coupled to a common collecting line, the two exhaust outlets symmetrically positioned across the central axis and having a same diameter, where each exhaust outlet of the two exhaust outlets has a passage axis arranged parallel to the central axis. A first exhaust outlet of the two exhaust outlets may be permanently blocked and a second exhaust outlet of the two exhaust outlets may be coupled to an exhaust system of an engine system.

20 Claims, 2 Drawing Sheets

(56) References Cited

U.S. PATENT DOCUMENTS

| | | | | |
|---|---|---|---|---|
| 2011/0132296 | A1* | 6/2011 | Kuhlbach | F01N 3/08 123/41.82 R |
| 2011/0171017 | A1* | 7/2011 | Lingenauber | F01D 9/026 415/203 |
| 2013/0055971 | A1* | 3/2013 | Brewer | F02F 1/24 123/41.82 R |
| 2013/0086891 | A1 | 4/2013 | Ko et al. | |
| 2014/0208727 | A1* | 7/2014 | Hayman | F01N 13/06 60/323 |
| 2015/0034408 | A1 | 2/2015 | Wu et al. | |
| 2015/0059339 | A1 | 3/2015 | Zahdeh et al. | |

* cited by examiner

INTERNAL COMBUSTION ENGINE HAVING AT LEAST ONE CYLINDER HEAD COMPRISING AT LEAST TWO CYLINDERS

CROSS REFERENCE TO RELATED APPLICATION

The present application claims priority to German Patent Application No. 102016201248.7, filed on Jan. 28, 2016. The entire contents of the above-referenced application are hereby incorporated by reference in its entirety for all purposes.

FIELD

The present description relates generally to systems for an integrated exhaust manifold of a cylinder head of an engine.

BACKGROUND/SUMMARY

Internal combustion engines have a cylinder block and at least one cylinder head which are connected to one another at their assembly end sides so as to form the individual cylinders, that is to say the combustion chambers.

To hold the pistons or the cylinder liners, the cylinder block has a corresponding number of cylinder bores. The pistons are guided in the cylinder liners in an axially movable fashion and form, together with the cylinder liners and the cylinder head, the combustion chambers of the internal combustion engine.

The cylinder head often also serves to hold the valve drive. To control the charge exchange, an internal combustion engine requires control elements and actuating devices for actuating said control elements. During the charge exchange, the combustion gases are discharged via the outlet openings, and the charging with fresh mixture or fresh air takes place via the inlet openings. To control the charge exchange, in four-stroke engines, use is made almost exclusively of lifting valves as control elements, which lifting valves perform an oscillating lifting movement during the operation of the internal combustion engine and which lifting valves open and close the inlet openings and outlet openings in this way. The valve actuating mechanism required for the movement of the valves, including the valves themselves, is referred to as the valve drive.

It is the object of the valve drive to open and close the inlet and outlet openings of the cylinders at the correct times, with a fast opening of the greatest possible flow cross sections being sought in order to keep the throttling losses in the inflowing and outflowing gas flows low and in order to ensure the best possible charging of the combustion chamber, and an effective discharge of the exhaust gases. Combustion chambers are also increasingly provided with two or more inlet openings and outlet openings.

The intake lines which lead to the inlet openings, and the exhaust lines which adjoin the outlet openings, may be at least partially integrated in the cylinder head. If two or more outlet openings are provided per cylinder, the exhaust lines of each cylinder are often merged—within the cylinder head—to form a partial exhaust line which is associated with the cylinder, before the partial exhaust lines are merged. The merging of the exhaust lines is referred to generally, and within the context of this disclosure, as an exhaust manifold or manifold.

Downstream in the exhaust-gas discharge system, the exhaust gases are then, if appropriate, supplied to the turbine of an exhaust-gas turbocharger and/or to one or more exhaust-gas aftertreatment systems.

In the case of exhaust-gas-turbocharged internal combustion engines, it is sought to arrange the turbine as close as possible to the outlet of the internal combustion engine in order thereby to be able to make optimum use of the exhaust-gas enthalpy of the hot exhaust gases, which is determined significantly by the exhaust-gas pressure and the exhaust-gas temperature, and to ensure a fast response behavior of the turbocharger, since in order to improve the response behavior, the exhaust-gas volume in the exhaust lines upstream of the turbine should be as small as possible.

Secondly, the path of the hot exhaust gases to the different exhaust-gas aftertreatment systems should also be as short as possible such that the exhaust gases are given little time to cool down and the exhaust-gas aftertreatment systems reach their operating temperature or light-off temperature as quickly as possible, in particular after a cold start of the internal combustion engine.

In this connection, it is therefore fundamentally sought to minimize the thermal inertia of the part of the exhaust line between the outlet opening at the cylinder and the exhaust-gas aftertreatment system or between the outlet opening at the cylinder and the turbine, which can be achieved by reducing the mass and the length of said part. The latter also reduces the surface area, which is acted on with exhaust gas, of the exhaust-gas discharge system upstream of the exhaust-gas aftertreatment system or upstream of the turbine, and therefore reduces the heat transfer.

With regard to the use of a turbocharger, it is sought to keep the pressure loss in the exhaust-gas flow as low as possible up to the inlet into the turbine, which may be achieved by way of suitable flow guidance and by a shortening of the exhaust lines or exhaust-gas paths.

To achieve the above-stated aims, the exhaust lines of the cylinders may be merged within the cylinder head so as to form a coherent integrated exhaust manifold, that is to say the exhaust manifold is integrated entirely in the cylinder head. Such a cylinder head is distinguished by a very compact design, with it being possible for the total length of the exhaust lines of the exhaust manifold and the volume of the exhaust lines upstream of a turbine arranged in the exhaust-gas discharge system, or of an exhaust-gas aftertreatment system arranged in the exhaust-gas discharge system, to be minimized.

The internal combustion engine to which the disclosure relates likewise has at least one such cylinder head, in which the exhaust lines of the at least two cylinders merge within the cylinder head so as to form an integrated exhaust manifold.

The integration of the exhaust manifold into the cylinder head furthermore permits dense packaging of the drive unit as a whole, and furthermore has the advantage that said exhaust manifold can benefit from a liquid-type cooling arrangement possibly provided in the cylinder head, in such a way that the manifold does not need to be manufactured from materials which can be subjected to high thermal load and which are thus expensive.

The use of such a cylinder head also leads to a reduced number of components, and consequently to a reduction in costs, in particular assembly and procurement costs.

The way in which the exhaust lines of the cylinders are merged in the specific situation, that is to say the design configuration of the exhaust manifold, is also dependent on the characteristic map areas or objectives for which the operating behavior of the internal combustion engine is to be optimized. Here, the exhaust-gas aftertreatment concept used, and a supercharging concept that may be provided, have a significant influence on the configuration of the manifold and on the exhaust line system connected thereto.

The dynamic wave phenomena occurring in the exhaust-gas discharge system in particular during the charge exchange must be taken into consideration.

In the case of supercharged internal combustion engines in which at least one turbine of an exhaust-gas turbocharger is provided in the exhaust-gas discharge system, impulse supercharging or ram supercharging may be desired.

It may be advantageous for the exhaust gas to be supplied for exhaust-gas aftertreatment immediately after passing through the turbine of an exhaust-gas turbocharger in order to realize or ensure a high conversion rate. In this respect, an exhaust-gas aftertreatment system may directly adjoin the turbine.

Such an arrangement is however hindered by the restricted space availability in the engine bay or on the cylinder head, and by a development trend toward large-volume exhaust-gas aftertreatment systems. The latter also arises from the fact that sufficiently large volumes are required to adhere to the ever more restrictive limit values for pollutant emissions. The volume of the exhaust-gas aftertreatment system has an influence on the residence time of the exhaust gas in the aftertreatment system and therefore on the conversion of the pollutants, that is to say the conversion rate.

Furthermore, use is increasingly made of combined exhaust-gas aftertreatment systems which comprise, that is to say combine, different catalytic converters and/or filters. Oxidation catalytic converters, nitrogen oxide storage catalytic converters, selective catalytic converters and/or particle filters are therefore combined to form integral exhaust-gas aftertreatment systems, as a result of which the volume of the aftertreatment systems is increased. Larger-dimensioned exhaust-gas aftertreatment systems, however, require more installation space, which opposes dense packaging and the most advantageous possible, that is to say close-coupled, arrangement.

The various demands of the different engine concepts generally require very different cylinder heads, or similar cylinder heads but with different integrated exhaust manifolds.

In one example, the issues described above may be addressed by an internal combustion engine having at least one cylinder head, comprising: at least two cylinders, each cylinder having at least one outlet opening for the discharge of the exhaust gases from the cylinder via an exhaust-gas discharge system, each outlet opening being adjoined by an exhaust line, and the exhaust lines of the at least two cylinders merging within the cylinder head so as to form a coherent integrated exhaust manifold, wherein the integrated exhaust manifold has at least two exhaust extraction lines which emerge from the cylinder head, where one exhaust extraction line of the at least two exhaust extraction lines is permanently blocked and has no passages coupled to it, downstream of the one exhaust extraction line.

In this way, the integrated exhaust manifold may be standardized and used in a variety of different engine systems. A standardization of the cylinder head used in engine systems would reduce costs, in particular because the cylinder head constitutes an expensive component of the internal combustion engine. A standardized cylinder head could be manufactured in large unit quantities and used, in accordance with the modular principle, with different engine concepts or internal combustion engines.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 1 is shown approximately to scale.

DETAILED DESCRIPTION

Figure 1:
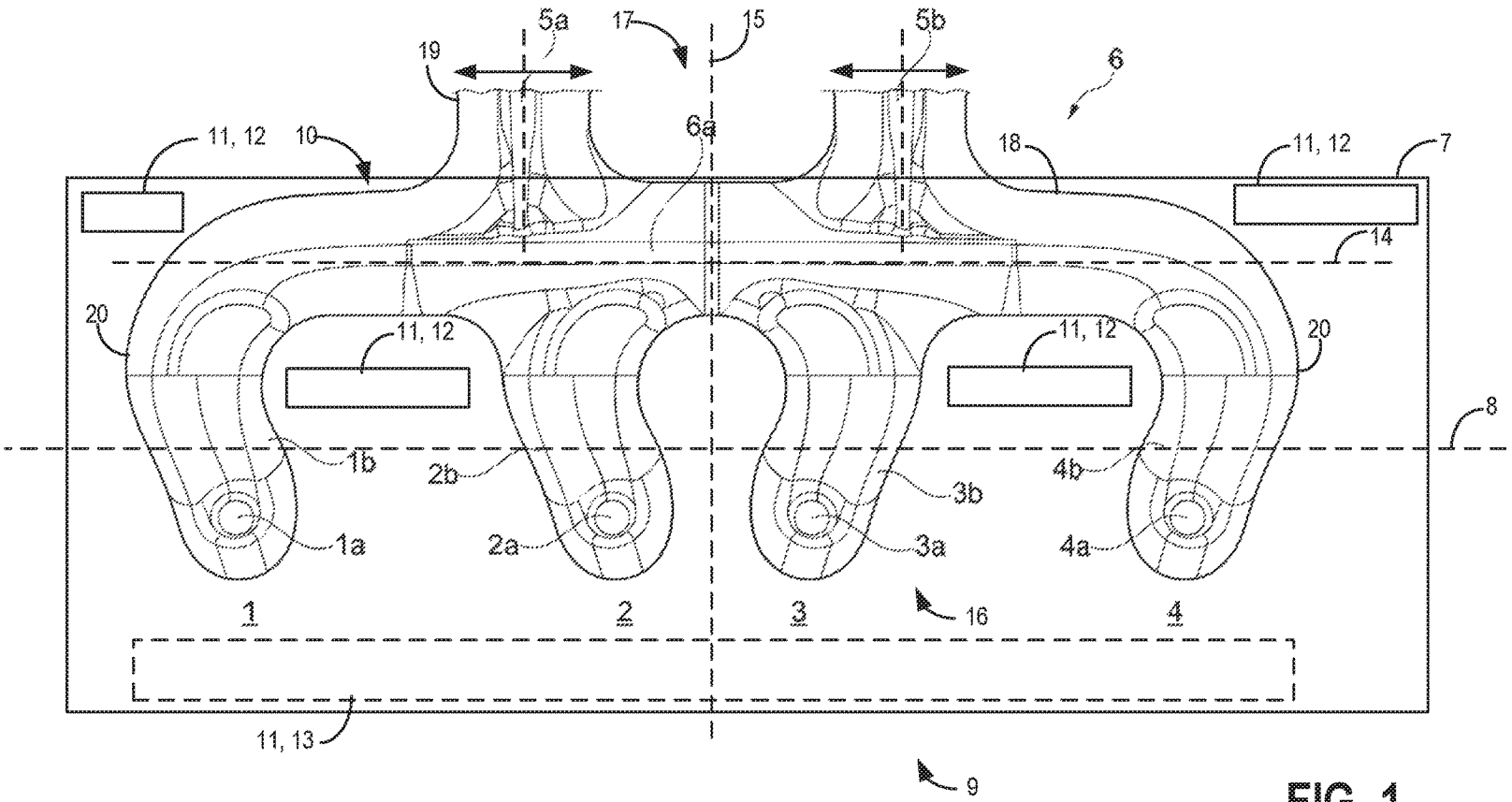
FIG. 1 shows, in a plan view, exhaust lines, integrated in a cylinder head, of a first embodiment of an internal combustion engine.

The following description relates to systems and methods for an internal combustion engine having at least one cylinder head comprising at least two cylinders, in which each cylinder has at least one outlet opening for discharging the exhaust gases out of the cylinder via an exhaust-gas discharge system, each outlet opening being adjoined by an exhaust line, and the exhaust lines of the at least two cylinders merge within the cylinder head so as to form a coherent integrated exhaust manifold.

An internal combustion engine of the stated type is used for example as a motor vehicle drive unit. Within the context of the present disclosure, the expression "internal combustion engine" encompasses in particular Otto-cycle engines but also diesel engines and hybrid internal combustion engines, which utilize a hybrid combustion process, and also hybrid drives which comprise not only the internal combustion engine but also an electric machine which can be connected in terms of drive to the internal combustion engine and which receives power from the internal combustion engine or which, as an activatable auxiliary drive, additionally outputs power.

Against the background of that stated above, it is the object of the present disclosure to provide an internal combustion, which has a cylinder head which can be used in the most versatile manner possible and which is substantially flexible with regard to the design of the exhaust-gas discharge system, in particular with regard to the arrangement of a turbine and/or of an exhaust-gas aftertreatment system.

Said object is achieved by means of an internal combustion engine having at least one cylinder head comprising at least two cylinders, in which each cylinder has at least one outlet opening for discharging the exhaust gases out of the cylinder via an exhaust-gas discharge system, each outlet opening being adjoined by an exhaust line, and the exhaust lines of the at least two cylinders merge within the cylinder head so as to form a coherent integrated exhaust manifold, and which internal combustion engine is distinguished by the fact that the integrated exhaust manifold has at least two exhaust extraction lines which emerge from the cylinder head.

According to the disclosure, the exhaust manifold integrated in the at least one cylinder head of the internal combustion engine has at least two exhaust extraction lines (also referred to herein as exhaust gas outlets). Said feature, according to which at least two exhaust extraction lines are provided, is to be interpreted in the context of the present disclosure to mean that at least two potential locations for the extraction of exhaust gas from the manifold are provided on the cylinder head, which locations however need not all be used in the fully assembled internal combustion engine.

That is to say, a potential extraction point need not in fact be used, though may be used in individual cases. The design feature of the at least two exhaust extraction lines provides a multiplicity of connection possibilities for the exhaust-gas discharge system or exhaust line system that connects to the cylinder head. In individual cases, it is possible for all of the exhaust extraction lines to be utilized, or else at least one exhaust extraction line.

The cylinder head can thus be adapted to different demands of different engine concepts. Through suitable selection of at least one exhaust extraction line or at least one extraction point, the operating behavior of the internal combustion engine can be optimized, or a specific concept for exhaust-gas aftertreatment and/or a specific supercharging concept can be allowed for or provided for.

The exhaust manifold designed according to the disclosure permits the standardization of the cylinder head, which can be used, in accordance with the modular principle, with different engine concepts or internal combustion engines. The proposed cylinder head can be manufactured in large unit amounts and therefore offers advantages in particular with regard to costs.

The close-coupled arrangement of an exhaust-gas aftertreatment system and of a turbine is greatly simplified.

By means of the internal combustion engine according to an embodiment of the disclosure, an internal combustion engine is provided which has a cylinder head which can be used in the most versatile manner possible and which is substantially flexible with regard to the design of the exhaust-gas discharge system, in particular with regard to the arrangement of a turbine and/or of an exhaust-gas aftertreatment system.

If the at least one cylinder head has three or more cylinders, the exhaust lines of said cylinders merge within the cylinder head, that is to say the exhaust lines of all of the cylinders of the at least one cylinder head merge, so as to form a manifold, within the cylinder head.

Embodiments of the internal combustion engine include where the integrated exhaust manifold has at least three exhaust extraction lines that emerge from the cylinder head.

Embodiments of the internal combustion engine include where the integrated exhaust manifold has at least four exhaust extraction lines that emerge from the cylinder head.

Embodiments of the internal combustion engine include where the at least two cylinders are arranged in a line along a longitudinal axis of the at least one cylinder head. Said embodiment constitutes inter alia the concept of the in-line engine, if the internal combustion engine has one cylinder head.

Embodiments of the internal combustion engine include where the exhaust lines of the at least two cylinders open into a common collecting line of the integrated exhaust manifold.

In this context, embodiments of the internal combustion engine include where the exhaust lines of the at least two cylinders open separately from one another on a cylinder-specific basis into the common collecting line of the integrated exhaust manifold.

In the present case, it is not the case that the exhaust lines are merged in stepped fashion such that the exhaust lines of two adjacent cylinders are firstly merged before these then jointly merge, downstream, with further exhaust lines of other cylinders.

Rather, the exhaust lines of all of the cylinders are merged in one step, that is to say are led into the common collecting line, wherein, in each case, the exhaust lines of one cylinder may be merged beforehand to form a cylinder-specific partial exhaust line if two or more outlet openings are provided per cylinder.

If the exhaust lines of the at least two cylinders open into a common collecting line of the integrated manifold, embodiments include where the common collecting line is oriented parallel to the longitudinal axis of the at least one cylinder head. In this way, the cylinder head is of particularly narrow width and is of very compact construction.

If a common collecting line is provided, embodiments of the internal combustion engine include where the at least two exhaust extraction lines branch off from the common collecting line.

Embodiments of the internal combustion engine include where at least two exhaust extraction lines emerge from a common outer wall of the at least one cylinder head. The outer wall may run parallel to the longitudinal axis of the cylinder head, such that said outer wall forms a longitudinal side of the head.

Exhaust-gas turbochargers and exhaust-gas aftertreatment systems may then be arranged to the side of the cylinder head and/or to the side of the cylinder block. Here, in individual cases, an exhaust-gas aftertreatment system may also extend in the direction of a cylinder. The impeller of a turbine of an exhaust-gas turbocharger may be arranged on that side of the integrated exhaust manifold which is averted from the assembly end side, or even on that side of the integrated exhaust manifold which faces toward the assembly end side. These lateral arrangements permit dense packaging.

Embodiments of the internal combustion engine include where each exhaust extraction line emerges from the at least one cylinder head with the formation of a flange. A flange offers the possibility of providing a screw-type connection, and thus the possibility of the cylinder head being connected to an external line system, or else the possibility of an unused exhaust extraction line being closed off.

Embodiments of the internal combustion engine may be advantageous in which the external exhaust-gas discharge system is connected to the at least one cylinder head in non-positively locking, positively locking and/or cohesive fashion.

Embodiments of the internal combustion engine include where at least one exhaust extraction line is closed off in the assembled state of the internal combustion engine, the exhaust-gas discharge system being connected to the at least one remaining exhaust extraction line.

Here, embodiments of the internal combustion engine include where the at least two exhaust extraction lines are closed off in the assembled state of the internal combustion engine apart from an exhaust extraction line to which the exhaust-gas discharge system is connected. Then, one exhaust extraction line conducts all of the exhaust gas of the cylinders of the cylinder head.

In this context, embodiments of the internal combustion engine include where the at least one exhaust extraction line that is closed off in the assembled state of the internal combustion engine is closed off by way of a plate-like element, the plate-like element being fastened to the at least one cylinder head, with the formation of a flange connection.

Since the cylinder head is generally a cast part, it would also be possible for the exhaust extraction lines of the cylinder head blank to be formed so as to be closed from the outset. All of the exhaust extraction lines that are formed so as to be closed constitute potential locations for the extraction of exhaust gas from the manifold. However, it is not necessary for every potential extraction point in fact be utilized and consequently opened. Rather, only the at least one exhaust extraction line or potential extraction point that is also utilized, or intended for utilization, in the individual case would be opened.

In general, however, at least one access point is required via which the sand core or casting core of the integrated manifold can be held and fixed in position during the casting process, such that at least one exhaust extraction line should be formed so as to be open from the outset, and all of the exhaust extraction lines may be formed so as to be open from the outset, wherein the exhaust extraction lines that are not utilized are closed off, for example by way of a plate-like element.

Embodiments of the internal combustion engine include where each cylinder has at least two outlet openings. As already mentioned, during the discharge of the exhaust gases within the context of the charge exchange, it is a primary aim to open up the largest possible flow cross sections as fast as possible in order to ensure an effective discharge of the exhaust gases, for which reason the provision of more than one outlet opening per cylinder is advantageous.

In this context, embodiments of the internal combustion engine include where the exhaust lines of the at least two outlet openings per cylinder merge to form a partial exhaust line associated with the cylinder, before said partial exhaust lines merge or open into a common collecting line.

The merging of the cylinder-specific exhaust lines to form cylinder-specific partial exhaust lines contributes to a more compact, that is to say less voluminous design of the cylinder head, and therefore in particular to a weight reduction and more effective packaging in the engine bay. Furthermore, the overall length of the exhaust lines of the exhaust manifold is shortened further.

Embodiments of the internal combustion engine include where the at least one cylinder head is equipped with an integrated coolant jacket.

As a result of the integration of the exhaust manifold, the cylinder head is thermally more highly loaded than a conventional cylinder head in the case of which an external manifold is provided, as a result of which higher demands are placed on the cooling arrangement.

It is fundamentally possible for the cooling arrangement to take the form of an air-type cooling arrangement or a liquid-type cooling arrangement. On account of the significantly higher heat capacity of liquids in relation to air, it is possible for significantly greater heat quantities to be dissipated by means of liquid cooling than is possible with air cooling.

Liquid cooling requires the internal combustion engine or the cylinder head to be equipped with an integrated coolant jacket, that is to say the arrangement of coolant ducts which conduct the coolant through the cylinder head. The heat is dissipated to the coolant, generally a water-glycol mixture, already in the interior of the cylinder head. Here, the coolant is fed by means of a pump arranged in the cooling circuit, such that said coolant circulates in the coolant jacket. The heat which is dissipated to the coolant is in this way dissipated from the interior of the cylinder head and extracted from the coolant again in a heat exchanger.

In the case of internal combustion engines in which the at least one cylinder head can be connected at an assembly end side to a cylinder block, embodiments are advantageous in this context which are distinguished by the fact that the coolant jacket has a lower coolant jacket, which is arranged between the integrated exhaust manifold and the assembly end side of the at least one cylinder head, and an upper coolant jacket, which is arranged on that side of the exhaust manifold which is situated opposite the lower coolant jacket.

Here, embodiments include where at least one connection between the lower coolant jacket and the upper coolant jacket, which connection serves for the passage of coolant, is provided spaced apart from the integrated exhaust manifold on that side of the exhaust manifold which faces away from the cylinders.

With the at least one connection, a coolant duct is arranged on that side of the integrated exhaust manifold which faces away from the at least two cylinders.

The cooling may additionally and advantageously be improved by virtue of a pressure gradient being generated between the upper and lower coolant jackets, as a result of which the speed in the at least one connection is in turn increased, which leads to an increased heat transfer as a result of convection.

Embodiments of the internal combustion engine include where at least one turbine of an exhaust-gas turbocharger is arranged in the exhaust-gas discharge system.

The advantages of an exhaust-gas turbocharger for example in relation to a mechanical charger are that no mechanical connection for transmitting power exists or is required between the charger and internal combustion engine. While a mechanical charger extracts the energy required for driving it entirely from the internal combustion engine, and thereby reduces the output power and consequently adversely affects the efficiency, the exhaust-gas turbocharger utilizes the exhaust-gas energy of the hot exhaust gases.

An exhaust-gas turbocharger comprises a compressor and a turbine which are arranged on the same shaft. The hot exhaust-gas flow is fed to the turbine and expands in the turbine with a release of energy, as a result of which the shaft is set in rotation. The energy supplied by the exhaust-gas flow to the turbine and ultimately to the shaft is used for driving the compressor which is likewise arranged on the shaft. The compressor delivers and compresses the charge air supplied to it, as a result of which supercharging of the at least two cylinders is obtained. A charge-air cooling arrangement may be provided, by means of which the compressed charge air is cooled before it enters the cylinders.

Supercharging serves primarily to increase the power of the internal combustion engine. Here, the air required for the combustion process is compressed, as a result of which a greater air mass can be supplied to each cylinder per working cycle. In this way, the fuel mass and therefore the mean pressure can be increased. Supercharging is a suitable means for increasing the power of an internal combustion engine while maintaining an unchanged swept volume, or for reducing the swept volume while maintaining the same power. In any case, supercharging leads to an increase in volumetric power output and a more expedient power-to-weight ratio. If the swept volume is reduced, it is thus possible to shift the load collective toward higher loads, at which the specific fuel consumption is lower. By means of supercharging in combination with suitable transmission configurations, it is also possible to realize so-called downspeeding, with which it is likewise possible to achieve a lower specific fuel consumption. Supercharging consequently assists in the constant efforts in the development of internal combustion engines to minimize fuel consumption, that is to say to improve the efficiency of the internal combustion engine.

The configuration of the exhaust-gas turbocharging often poses difficulties, wherein it is basically sought to obtain a noticeable performance increase in all rotational speed ranges. A severe torque drop may, however, be observed in the event of a certain engine speed being undershot. Said torque drop is understandable if one takes into consideration that the charge pressure ratio is dependent on the turbine pressure ratio. For example, if the engine speed is reduced, this leads to a smaller exhaust-gas mass flow and therefore to a lower turbine pressure ratio. This has the result that, toward lower engine speeds, the charge pressure ratio and the charge pressure likewise decrease, which equates to a torque drop.

It is possible, using a variety of measures, to improve the torque characteristic of a supercharged internal combustion engine.

One such measure, for example, is a small design of the turbine cross section and simultaneous provision of an exhaust-gas blow-off facility. Such a turbine is also referred to as a wastegate turbine. If the exhaust-gas flow rate exceeds a critical value, a part of the exhaust-gas flow is, within the course of the so-called exhaust-gas blow-off, conducted via a bypass line past the turbine. This approach has the disadvantage that the supercharging behavior is inadequate at relatively high rotational speeds or in the case of relatively high exhaust-gas quantities.

The torque characteristic may also be advantageously influenced by means of multiple exhaust-gas turbochargers connected in series. By connecting two exhaust-gas turbochargers in series, of which one exhaust-gas turbocharger serves as a high-pressure stage and one exhaust-gas turbocharger serves as a low-pressure stage, the compressor characteristic map can advantageously be expanded, specifically both in the direction of smaller compressor flows and also in the direction of larger compressor flows.

The torque characteristic of a supercharged internal combustion engine may furthermore be improved by means of multiple turbochargers arranged in parallel, that is to say by means of multiple turbines of relatively small turbine cross section arranged in parallel, wherein turbines are activated successively with increasing exhaust-gas flow rate.

Embodiments of the internal combustion engine may also include at least one exhaust-gas aftertreatment system that is arranged in the exhaust-gas discharge system.

Embodiments of the internal combustion engine include where the at least one exhaust-gas aftertreatment system is a combined exhaust-gas aftertreatment system.

Embodiments of the internal combustion engine include where at least two exhaust extraction lines do not have a recirculation line of an exhaust-gas recirculation arrangement connected thereto. Nevertheless, a recirculation line may be provided which branches off from the exhaust-gas discharge system or from the integrated manifold.

Here, embodiments of the supercharged internal combustion engine may include where the combined exhaust-gas aftertreatment system is a four-way catalytic converter, an oxidation catalytic converter, a storage catalytic converter or a particle filter.

FIG. 1 shows, in a plan view, the exhaust lines 1*b*, 2*b*, 3*b*, 4*b*, integrated in the cylinder head, of a first embodiment of the internal combustion engine. Specifically, FIG. 1 shows a cylinder head 7 including an integrated exhaust manifold 6. The cylinder head 7 includes a longitudinal axis 8.

The cylinder head 7 belonging to the illustrated integrated exhaust manifold 6 has four cylinders 1, 2, 3, 4 in an in-line arrangement. The embodiment in question consequently involves a four-cylinder in-line engine. For example, the four cylinders 1, 2, 3, and 4 are arranged in a line, along the longitudinal axis 8.

As introduced above, the cylinder head 8 can be connected at an assembly end side 9 (e.g., into the page in FIG. 1) to a cylinder block. The cylinder head 8 may include an opposite, or upper end side 10 (e.g., out of the page in FIG. 1) that is arranged opposite the assembly end side 9. The cylinder head 8 may include an integrated coolant jacket 11 which includes an upper coolant jacket 12 and a lower coolant jacket 13. The lower coolant jacket 13 may be arranged between the integrated exhaust manifold 6 and the assembly end side 9 of the cylinder head 8 and the upper coolant jacket 13 may be arranged on the upper end side 10. Though the upper and lower coolant jackets are shown schematically in FIG. 1, the upper coolant jacket 13 may surround the entire integrated exhaust manifold 6, in one example.

Each of the four cylinders 1, 2, 3, 4 has an outlet opening 1*a*, 2*a*, 3*a*, 4*a*, each outlet opening 1*a*, 2*a*, 3*a*, 4*a* being adjoined by an exhaust line 1*b*, 2*b*, 3*b*, 4*b* for the discharge of the exhaust gas. Thus, the outlet openings 1*a*, 2*a*, 3*a*, 4*a* may also be referred to herein an exhaust inlets to the integrated exhaust manifold 6.

The exhaust lines 1*b*, 2*b*, 3*b*, 4*b* of the cylinders 1, 2, 3, 4 merge within the cylinder head so as to form a coherent integrated exhaust manifold 6, wherein the exhaust lines 1*b*, 2*b*, 3*b*, 4*b* open separately from one another on a cylinder-specific basis into a common collecting line 6*a* of the integrated exhaust manifold 6. In the present case, the common collecting line 6*a* runs parallel to the longitudinal axis 8 of the cylinder head, which yields a narrow, compact cylinder head. For example, the common collecting line includes a passage axis 14 which is arranged in parallel with the longitudinal axis 8 of the cylinder head. Additionally, the integrated exhaust manifold 6 includes a central axis 15. The central axis 15 runs from an inlet end (e.g., where exhaust gas enters the integrated exhaust manifold) 16 to an outlet end (e.g., where exhaust gas exits the integrated exhaust manifold) 17 of the integrated exhaust manifold 6. The central axis 15 also separates cylinders 1 and 2 from cylinders 3 and 4. Additionally, the integrated exhaust manifold 6 may be symmetric (e.g., have mirror symmetry) across the central axis 15.

The integrated exhaust manifold 6 has at least two exhaust extraction lines (e.g., exhaust outlets) 5*a*, 5*b* which emerge from the cylinder head 7. The two exhaust extraction lines 5*a*, 5*b* emerge, spaced apart from one another, from a common outer wall 18 of the cylinder head, which outer wall runs parallel to the longitudinal axis 8 of the cylinder head 7 and thus forms a longitudinal side of the head. Each exhaust extraction line 5*a*, 5*b* may emerge from the cylinder head 7 with the formation of a flange 19. Additionally, as shown in FIG. 1, the two exhaust extraction lines are equal in size and symmetrically arranged relative to (e.g., across) the central axis 15. For example, each of the two exhaust extraction lines 5*a*, 5*b* have a same diameter and are spaced a same distance from the central axis 15 and a respective, closest outside edge of the integrated exhaust manifold 6.

Figure 2:
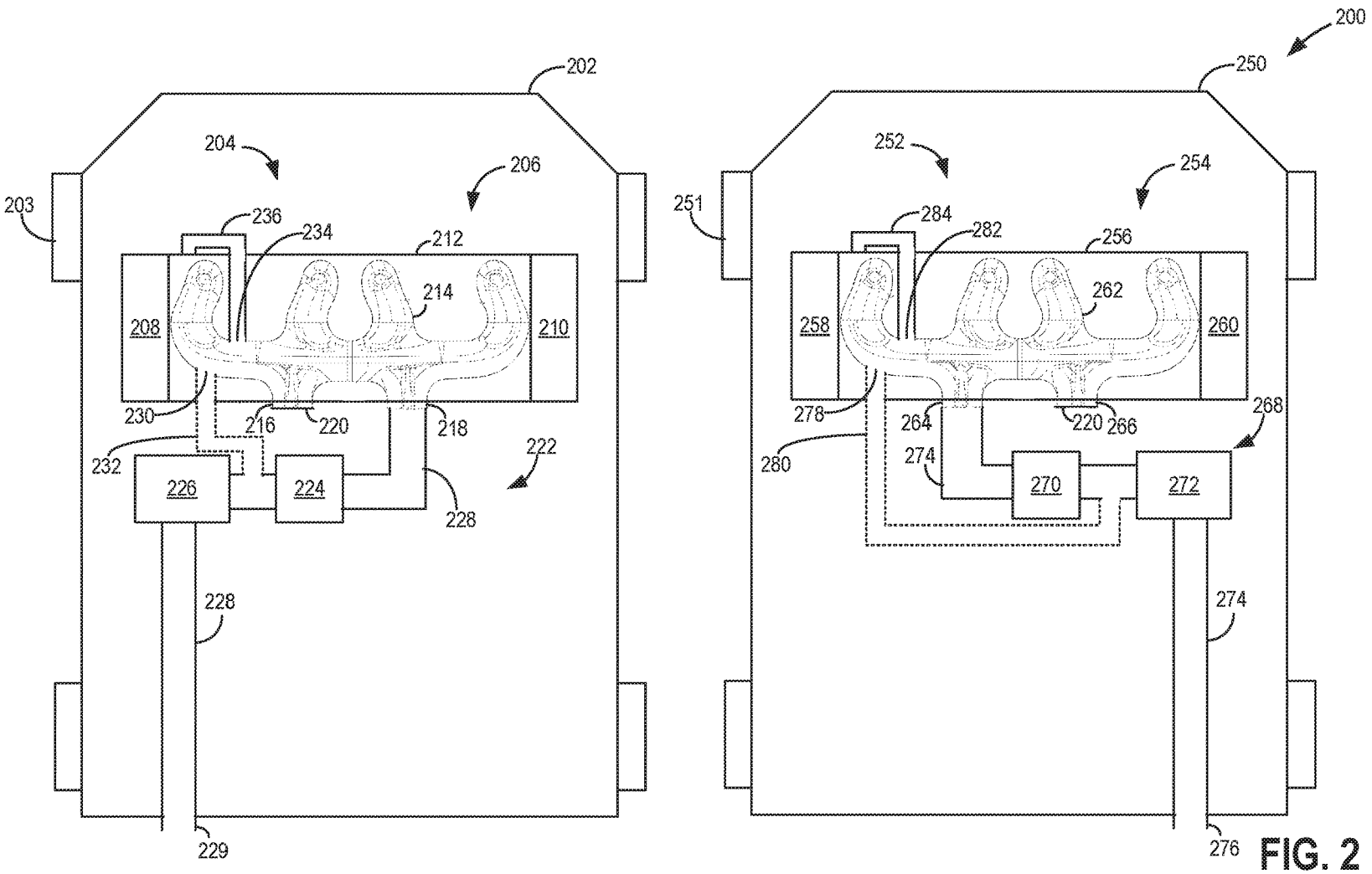
FIG. 2 shows a line of vehicles where each engine system of each vehicle has an integrated exhaust manifold with similar geometry.

In the assembled state of the internal combustion engine, the two exhaust extraction lines 5*a*, 5*b* serve for the extraction of exhaust gas from the integrated exhaust manifold 6 to which the external exhaust-gas discharge system is connected, as shown in FIG. 2.

FIG. 1 shows example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Turning now to FIG. 2, a line a vehicles 200 where each engine system of each vehicle has an integrated exhaust manifold with the same geometry is shown. The integrated exhaust manifolds shown in FIG. 2 may have the same geometry and configuration as the integrated exhaust manifold 6 shown in FIG. 1. Thus, the vehicles shown in FIG. 2 may each include an integrated exhaust manifold (and cylinder head) of the type and configuration shown in FIG. 1. Specifically, the line of vehicles includes a first vehicle 202 and a second vehicle 250.

The first vehicle 202 includes wheels 203 and is propelled via a first engine system 204 positioned therein. The first engine system 204 includes a first engine 206 which includes a first cylinder head 212 positioned between a front end 208 and transmission end 210 (e.g., that may include a transmission of the engine) of the first engine 206. As shown in FIG. 2, the front end 208 of the first engine 206 is closer to a left side of the first vehicle 202 than a right side of the first vehicle 202 and the transmission end 210 is positioned closer to the right side than the left side of the first vehicle 202. However, in alternate embodiments, this configuration may be reversed and the front end 208 may be positioned closer to the right side of the first vehicle 202 than the right side of the first vehicle 202 and the transmission end 210 may be positioned closer to the left side than the right side of the first vehicle 202. The first cylinder head 212 includes a first integrated exhaust manifold 214 which may have the same geometry and features as the integrated exhaust manifold 6 described above with reference to FIG. 1. The first integrated exhaust manifold 214 includes a first exhaust outlet (e.g., exhaust extraction line) 216 and a second exhaust outlet 218. The first exhaust outlet 216 is positioned closer to the front end 208 than the second exhaust outlet 218 which is positioned closer to the transmission end 210 than the first exhaust outlet 216.

In the embodiment shown in FIG. 2, the first exhaust outlet 216 is permanently blocked (e.g., closed off) via a plate-like element 220. The plate-like element 220 may include a plate, cap, seal, or other fixture that is mechanically and permanently fixed (e.g., via a mechanical fixing element such as a screw or bolt and/or via welding) to an end of the first exhaust outlet 216 so that not exhaust gas may exit the first exhaust outlet 216. Further, as seen in FIG. 2, no additional passages or engine elements are coupled to the first exhaust outlet 216, downstream of the first integrated exhaust manifold 214 and the end of the first exhaust outlet 216.

The second exhaust outlet 218 is not permanently blocked and instead it is coupled to an exhaust gas discharge system 222 of the first engine system 204. The gas discharge system 222 includes a turbine 224 of a turbocharger and an exhaust gas aftertreatment system 226 positioned within an exhaust passage 228 that runs from the second exhaust outlet 218 to an exhaust pipe (e.g., tailpipe) 229 of the first engine system 204. As shown for the first vehicle 202, the exhaust passage (e.g., conduit) 228 is directly coupled to the second exhaust outlet 218. In one embodiment, the first exhaust outlet 216 and second exhaust outlet 218 may be the only exhaust outlets of the first integrated exhaust manifold 214. In another embodiment, the first integrated exhaust manifold 214 may additionally include a third exhaust outlet 230 that is offset from the first and second exhaust outlets and may have a different diameter than the first and second exhaust outlets. As shown in FIG. 2, the third exhaust outlet 230 is coupled to a bypass passage 232 which is coupled to the exhaust passage 228, downstream of the turbine. In this way, exhaust gases exiting the engine cylinders may bypass the turbine 224 via the bypass passage 232. In an alternate embodiment, instead of being permanently blocked, the first exhaust outlet 216 may be coupled to the bypass passage 232 and thus exhaust gases from first exhaust outlet 216 may flow downstream of the turbine 224 via the bypass passage 232. In this alternate embodiment, the first integrated exhaust manifold 214 may not include the third exhaust outlet 230.

In yet another embodiment, the first integrated exhaust manifold 214 may include an additional fourth exhaust outlet 234 (e.g., in addition to the first and second exhaust outlets only or in addition to the first, second, and third exhaust outlets). The fourth exhaust outlet 234 may be positioned on an opposite side of the common collecting line than the first and second exhaust outlets (as shown in FIG. 2) or on a same side of the common collecting line as the first and second exhaust outlets. The fourth exhaust outlet 234 may have a different shape and/or diameter than the first and second exhaust outlets. The fourth exhaust outlet 234 may be coupled to an exhaust gas recirculation passage 236 that routes exhaust gases from the first integrated exhaust manifold 214 to an intake passage of the first engine 206.

The second vehicle 250 includes wheels 251 and is propelled via a second engine system 252 positioned therein. The second engine system 252 includes a second engine 254 which includes a second cylinder head 256 positioned between a front end 258 and transmission end 260 (e.g., that may include a transmission of the engine) of the second engine 254. Similarly to the first vehicle 202, the front end 258 of the second engine 254 is closer to a left side of the second vehicle 250 than a right side of the second vehicle 250 and the transmission end 260 is positioned closer to the right side than the left side of the second vehicle 250. However, in alternate embodiments, this configuration may be reversed and the front end 258 may be positioned closer to the right side of the second vehicle 250 than the right side of the second vehicle 250 and the transmission end 260 may be positioned closer to the left side than the right side of the second vehicle 250. The second cylinder head 256 includes a second integrated exhaust manifold 262 which may have the same geometry and features as the integrated exhaust manifold 6 described above with reference to FIG. 1 and as the first integrated exhaust manifold 214 of the first engine system 204 of the first vehicle 202. As described further below, the cylinder blocks and/or integrated exhaust manifolds of both the first vehicle 202 and the second vehicle 250 may be identical (e.g., same geometry and number of inlets/outlets that all have the same shape and size) except for which of the first and second exhaust outlets are blocked and coupled to the respective exhaust gas discharge systems.

For the second engine system 252, the second integrated exhaust manifold 262 includes a first exhaust outlet (e.g., exhaust extraction line) 264 and a second exhaust outlet 266. The first exhaust outlet 264 is positioned closer to the front end 258 than the second exhaust outlet 266 which is positioned closer to the transmission end 260 than the first exhaust outlet 264. In the second vehicle 254, the second exhaust outlet 266 is permanently blocked (e.g., closed off) via a plate-like element 220. Thus, no exhaust gases may exit the second exhaust outlet 266. Further, no additional passages or engine elements are coupled to the second exhaust outlet 266, downstream of the second integrated exhaust manifold 262 and the end of the second exhaust outlet 266.

The first exhaust outlet 264 is not permanently blocked and instead it is coupled to an exhaust gas discharge system 268 of the second engine system 252. The gas discharge system 268 includes a turbine 270 of a turbocharger and an exhaust gas aftertreatment system 272 positioned within an exhaust passage 274 that runs from the first exhaust outlet 264 to an exhaust pipe (e.g., tailpipe) 276 of the second engine system 252. As shown for the second vehicle 250, the exhaust passage (e.g., conduit) 274 is directly coupled to the first exhaust outlet 264. In one embodiment, the first exhaust outlet 264 and second exhaust outlet 266 may be the only exhaust outlets of the second integrated exhaust manifold 262. In another embodiment, the second integrated exhaust manifold 262 may additionally include a third exhaust outlet 278 that is offset from the first and second exhaust outlets and may have a different diameter than the first and second exhaust outlets. As shown in FIG. 2, the third exhaust outlet 278 is coupled to a bypass passage 280 which is coupled to the exhaust passage 274, downstream of the turbine 270. In this way, exhaust gases exiting the engine cylinders may bypass the turbine 270 via the bypass passage 280. In an alternate embodiment, instead of being permanently blocked, the second exhaust outlet 266 may be coupled to the bypass passage 280 and thus exhaust gases from second exhaust outlet 266 may flow downstream of the turbine 270 via the bypass passage 280. In this alternate embodiment, the second integrated exhaust manifold 262 may not include the third exhaust outlet 278.

In yet another embodiment, the second integrated exhaust manifold 262 may include an additional fourth exhaust outlet 282 (e.g., in addition to the first and second exhaust outlets only or in addition to the first, second, and third exhaust outlets). The fourth exhaust outlet 282 may be positioned on an opposite side of the common collecting line than the first and second exhaust outlets (as shown in FIG. 2) or on a same side of the common collecting line as the first and second exhaust outlets. The fourth exhaust outlet 282 may have a different shape and/or diameter than the first and second exhaust outlets. The fourth exhaust outlet 282 may be coupled to an exhaust gas recirculation passage 284 that routes exhaust gases from the second integrated exhaust manifold 262 to an intake passage of the second engine 254.

Thus, the first vehicle 202 and second vehicle 250 may include identical (e.g., same size, shape, and geometry) integrated exhaust manifolds. However, the integrated exhaust manifolds may have different exhaust outlets permanently closed off in the different vehicles. For example, the first engine system 204 has a turbine 224 and exhaust gas aftertreatment system 226 that are oriented closer to the front end 208. To decrease packaging space, the first exhaust outlet 216 (which is closer to the front end 208) is permanently blocked via the plate-like element 220 and the second exhaust outlet 218 is coupled to the exhaust gas discharge system 222. In contrast, the second engine system 252 of the second vehicle 250 has a turbine 270 and exhaust gas aftertreatment system 272 that are oriented closer to the transmission end 260. Thus, the second exhaust outlet 266 (which is closer to the transmission end 260) is permanently blocked via the plate-like element 220 and the first exhaust outlet 264 is coupled to the exhaust gas discharge system 268. In this way, a single integrated exhaust manifold (or cylinder head including the integrated exhaust manifold) may be manufactured and used in a variety of vehicle and engine systems which may have different components or a different orientation of components. This may reduce manufacturing costs and complexity. By changing which exhaust gas outlet is permanently blocked off, the same integrated exhaust manifold may be used in a variety of vehicle and engine systems.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine having at least one cylinder head, comprising:

at least two cylinders, each cylinder having at least one outlet opening for discharge of exhaust gases from the cylinder via an exhaust-gas discharge system, each outlet opening being adjoined by an exhaust line, and the exhaust lines of the at least two cylinders merging within the cylinder head so as to form a coherent integrated exhaust manifold, wherein the integrated exhaust manifold has at least two exhaust extraction lines which emerge from the cylinder head, where one exhaust extraction line of the at least two exhaust extraction lines is permanently blocked and has no passages coupled to it, downstream of the other exhaust extraction line.

2. The internal combustion engine as claimed in claim 1, wherein the at least two cylinders are arranged in a line along a longitudinal axis of the at least one cylinder head.

3. The internal combustion engine as claimed in claim 2, wherein the exhaust lines of the at least two cylinders open into a common collecting line of the integrated exhaust manifold.

4. The internal combustion engine as claimed in claim 3, wherein the exhaust lines open separately from one another on a cylinder-specific basis into the common collecting line of the integrated exhaust manifold.

5. The internal combustion engine as claimed in claim 3, wherein the common collecting line is oriented parallel to the longitudinal axis of the at least one cylinder head.

6. The internal combustion engine as claimed in claim 3, wherein the at least two exhaust extraction lines branch off from the common collecting line.

7. The internal combustion engine as claimed in claim 1, wherein the at least two exhaust extraction lines emerge from a common outer wall of the at least one cylinder head.

8. The internal combustion engine as claimed in claim 1, wherein each exhaust extraction line emerges from the at least one cylinder head with formation of a flange.

9. The internal combustion engine as claimed in claim 1, wherein the one exhaust extraction line is permanently closed off in an assembled state of the internal combustion engine and wherein the exhaust-gas discharge system is connected to a remaining one of the two exhaust extraction lines which is not permanently closed off.

10. The internal combustion engine as claimed in claim 9, wherein the one exhaust extraction line that is permanently closed off in the assembled state of the internal combustion engine is closed off by way of a plate-like element, the plate-like element being fastened to the at least one cylinder head.

11. The internal combustion engine as claimed in claim 1, wherein each cylinder has at least two outlet openings and wherein the exhaust lines of the at least two outlet openings per cylinder merge to form a partial exhaust line associated with the cylinder, before said partial exhaust lines merge.

12. The internal combustion engine as claimed in claim 1, wherein the at least one cylinder head is equipped with an integrated coolant jacket, wherein the at least one cylinder head can be connected at an assembly end side to a cylinder block, wherein the coolant jacket has a lower coolant jacket, which is arranged between the integrated exhaust manifold and the assembly end side of the at least one cylinder head, and an upper coolant jacket, which is arranged on that side of the integrated exhaust manifold which is situated opposite the lower coolant jacket.

13. The internal combustion engine as claimed in claim 1, wherein at least one turbine of an exhaust-gas turbocharger is arranged in the exhaust-gas discharge system and wherein at least one exhaust-gas aftertreatment system is arranged in the exhaust-gas discharge system.

14. The internal combustion engine as claimed in claim 1, wherein the at least two exhaust extraction lines do not have a recirculation line of an exhaust-gas recirculation arrangement connected thereto.

15. A vehicle line, comprising:

a plurality of vehicles including:

a first vehicle that includes a first engine system including a first engine with a first integrated exhaust manifold (IEM) including two exhaust outlets of equal size which are symmetrically positioned, where a first exhaust outlet of the two exhaust outlets of the first IEM is positioned closer to a front end of the first engine than a second exhaust outlet of the two exhaust outlets of the first IEM and where the first exhaust outlet of the first IEM is permanently blocked and the second exhaust outlet of the first IEM is coupled to a first exhaust system of the first engine system; and a second vehicle that includes a second engine system including a second engine with a second IEM having a same geometry as the first IEM and including two exhaust outlets of equal size which are symmetrically positioned, where a first exhaust outlet of the two exhaust outlets of the second IEM is positioned closer to a front end of the second engine than a second exhaust outlet of the two exhaust outlets of the second IEM and where the first exhaust outlet of the second IEM is coupled to a second exhaust system of the second engine system and the second exhaust outlet of the second IEM is permanently blocked.

16. The vehicle line of claim 15, wherein the two exhaust outlets of the first IEM are symmetrically positioned with respect to a central axis of the first IEM, the central axis of the first IEM running from an inlet end to an outlet end of the first IEM, and wherein the two exhaust outlets of the second IEM are symmetrically positioned with respect to a central axis of the second IEM, the central axis of the second IEM running from an inlet end to an outlet end of the second IEM.

17. The vehicle line of claim 16, wherein each exhaust outlet of the two exhaust outlets of the first IEM includes a passage axis that is arranged parallel to the central axis of the first IEM and wherein each exhaust outlet of the two exhaust outlets of the second IEM includes a passage axis that is arranged parallel to the central axis of the second IEM.

18. The vehicle line of claim 15, wherein a first turbine of the first engine system is positioned closer to a front end of the first engine than a transmission end of the first engine and wherein a second turbine of the second engine system is positioned closer to a transmission end of the second engine than a front end of the second engine system.

19. An engine system, comprising:

an exhaust passage including a turbocharger turbine and an exhaust gas aftertreatment system; and an integrated exhaust manifold including:

a central axis running from an inlet end to an outlet end of the integrated exhaust manifold;

a plurality of exhaust lines arranged at the inlet end, each exhaust line of the plurality of exhaust lines coupled to a respective cylinder outlet opening, the plurality of exhaust lines combining into a common collecting line with a common passage axis aligned perpendicular to the central axis; and two exhaust outlets arranged at the outlet end and coupled to the common collecting line, the two exhaust outlets symmetrically positioned across the central axis and having a same diameter, where each exhaust outlet of the two exhaust outlets has a passage axis arranged parallel to the central axis, and where a first exhaust outlet of the two exhaust outlets is permanently blocked and only a second exhaust outlet of the two exhaust outlets is coupled to the exhaust passage.

20. The engine system of claim 19, wherein the integrated exhaust manifold further includes a third exhaust outlet coupled to one of the exhaust passage, downstream of the turbine, and an intake passage, upstream of engine cylinders, via an exhaust gas recirculation passage of the engine system.

* * * * *